United States Patent [19]

Ilg

[11] 4,430,047

[45] Feb. 7, 1984

[54] PUMP ARRANGEMENT

[75] Inventor: Rudolf Ilg, Aalen, Fed. Rep. of Germany

[73] Assignee: Zahndradfabrik Friedrichshafen AG, Friedrichshafen, Fed. Rep. of Germany

[21] Appl. No.: 216,966

[22] Filed: Dec. 16, 1980

[30] Foreign Application Priority Data

Dec. 19, 1979 [DE] Fed. Rep. of Germany ..... 2951012

[51] Int. Cl.[3] ..... F04B 23/04; F04B 1/04

[52] U.S. Cl. ..... 417/273; 417/426

[58] Field of Search ..... 417/426.6, 428, 539, 417/273, 271

[56] References Cited

U.S. PATENT DOCUMENTS

| | | | |
|---|---|---|---|
| 2,461,235 | 2/1949 | Raymond | 417/273 |
| 2,472,355 | 6/1949 | Whittingham | 417/273 |
| 2,697,403 | 12/1954 | Benedok | 417/521 |
| 2,941,475 | 6/1960 | Blair | 417/238 |
| 3,228,587 | 1/1966 | Segebrecht | 417/238 |
| 3,426,696 | 2/1969 | Poynter | 417/539 |
| 3,492,946 | 2/1970 | Martin | 417/534 |
| 3,871,793 | 3/1975 | Olson, Jr. | 417/273 |
| 4,332,532 | 1/1982 | Liska | 417/273 |

FOREIGN PATENT DOCUMENTS

| | | | |
|---|---|---|---|
| 2505400 | 8/1976 | Fed. Rep. of Germany | 417/273 |
| 2521648 | 8/1976 | Fed. Rep. of Germany | 417/273 |
| 2026089 | 1/1980 | United Kingdom | 417/273 |

*Primary Examiner*—William L. Freeh

*Attorney, Agent, or Firm*—Zalkind & Shuster

[57] ABSTRACT

At least two radial piston pumps having a common eccentric rotatable within an eccentric chamber of the pump housing supply pressurized fluid to separate fluid circuits. The eccentric chamber is divided into separate fluid delivery compartments to which fluid is conducted from a common suction port by the pumps through passages that dampen the transfer of pressure fluctuations between the fluid circuits.

9 Claims, 3 Drawing Figures

PUMP ARRANGEMENT

BACKGROUND OF THE INVENTION

This invention relates to multiple pump assemblies for operating fluid powered equipment in a motor vehicle or the like.

The combination of a vane pump and a radial piston pump in tandem for supplying two separate fluid circuits is already known, as disclosed for example in prior German patent application DE-PS 28 03 772. In such an arrangement, the drive shafts of both pumps are coupled with each other by means of a cross-disc coupling. Each pump has its own suction connection to a common fluid reservoir tank. By way of example, the vane pump supplies pressurized fluid to a fluid powering steering circuit while the radial piston pump supplies pressurized fluid to a fluid powering brake circuit associated with a motor vehicle. According to such prior pump arrangements, the vane pump requires a relatively high energy input as the power output demand increases proportionately with the increase in pump speed. The volumetric output of the vane pump is therefore adjusted for a relatively low pump speed by a control valve on the output pressure side of the pump.

In plural pump arrangements of the foregoing type, the consumption of input energy is somewhat wasteful. Measures ordinarily taken to conserve energy generally involve the addition of costly components. Furthermore, in such plural pump arrangements, pressure pulsations developed in one of the fluid circuits is transferred to the other of the fluid circuits.

It is therefore an important object of the present invention to provide a pump arrangement assembled from two or more pumps which consumes a minimum amount of energy and wherein manufacturing costs are maintained at a minimum. An additional object in accordance with the foregoing object is to provide a plural pump arrangement servicing plural fluid pressure circuits without mutual interference between such circuits caused by pressure pulsations in one of the circuits.

SUMMARY OF THE INVENTION

In accordance with the present invention, at least two radial piston pumps automatically regulated on the suction side in a manner already known in the art, receives increasing power that remains constant above a predetermined speed within the speed operating range of the pump arrangement. Accordingly, it is possible to conserve input energy as compared to known pump arrangements of the aforementioned type. Furthermore, construction is simplified by elimination of any flow control ordinarily required for the vane pump associated with prior pump arrangements. The pump arrangement of the present invention therefore includes only radial piston pumps operated by a common drive shaft for supply of separate fluid circuits from a common fluid reservoir tank. The drive shaft is advantageously provided with a single eccentric for causing reciprocation of the pistons respectively associated with each of the pumps. A common pump housing encloses a chamber, eccentric to the rotational axis of the common drive shaft, within which the common eccentric operates. The eccentric chamber is divided into separate compartments respectively assigned to the pumps, by means of which mutual interference between the fluid circuits is avoided. Ordinarily, such interference occurs when pressure pulsations are produced in response to the entry of a piston plunger into the eccentric chamber. The compartments into which the eccentric chamber is divided, are in fluid communication with a common suction port. The use of a common suction port and and a common eccentric chamber simplifies the construction of the pump assembly.

Pressure pulsations otherwise occurring particularly in a fluid steering circuit is additionally minimized by establishing fluid communication between the common eccentric chamber and suction port through annular channels. Where the annular channels are arranged in radial alignment with each other, they are advantageously connected to the chamber through radial flow restrictors. As a result, it is possible to almost completely suppress pressure fluctuations which would cause the piston plungers to be filled with fluid at different flow rates, a problem that especially plagues the fluid steering circuit.

BRIEF DESCRIPTION OF DRAWING FIGURES

Embodiments of the invention are hereinafter described with reference to the accompanying drawings, wherein.

DETAILED DESCRIPTION OF PREFERRED EMBODIMENTS

Figure 1:
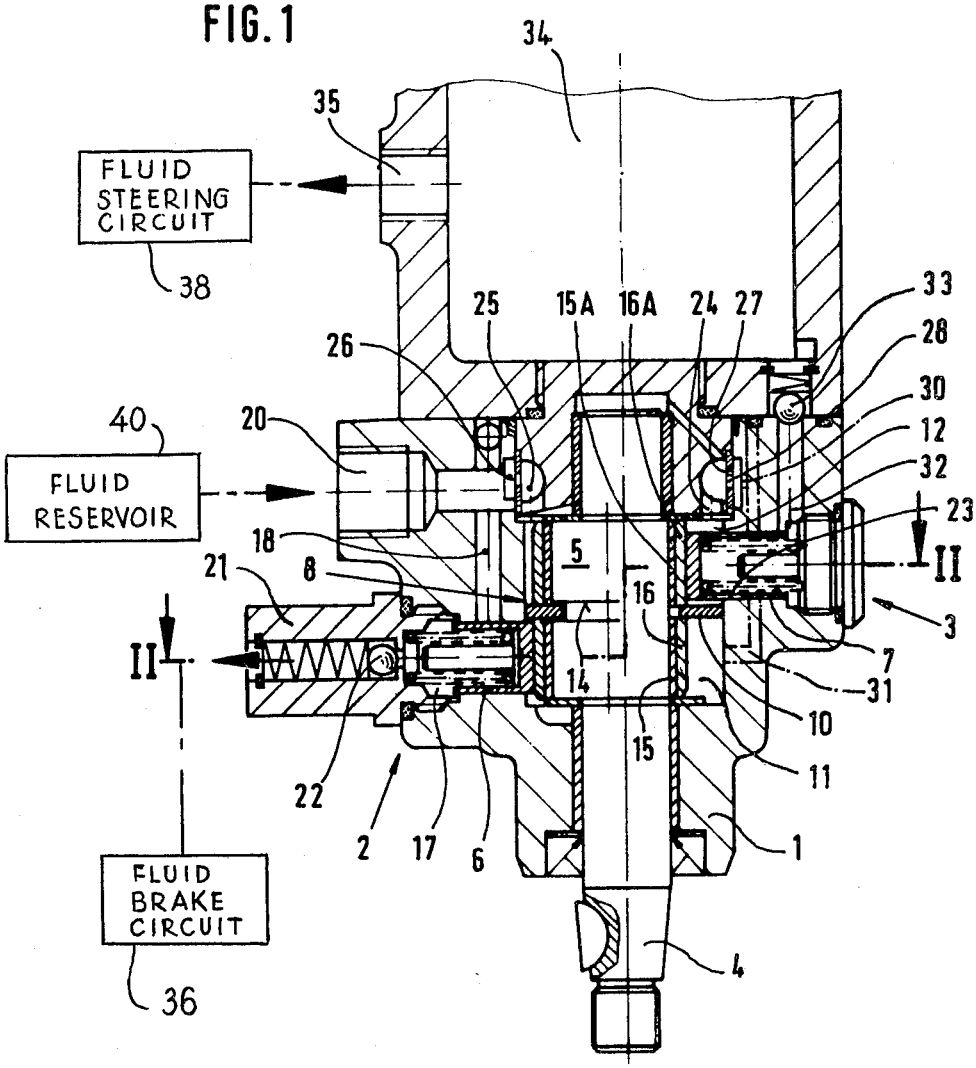
FIG. 1 is a longitudinal section view through a dual pump assembly constructed in accordance with one embodiment of the present invention.
Figure 2:
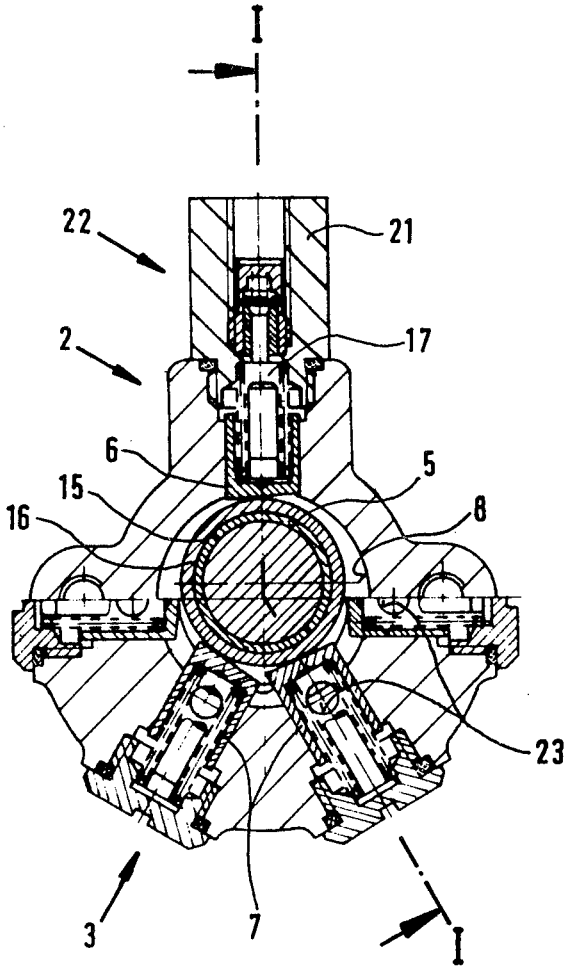
FIG. 2 is a transverse section view taken substantially through a plane indicated by a section line II—II in FIG. 1 and rotated by 90°.

Referring now the drawings in detail, FIGS. 1 and 2 illustrate a dual pump assembly enclosed by a pump housing generally referred to by reference numeral 1. The pump assembly includes a single-cylinder radial piston pump 2 and a six-cylinder radial piston pump 3.

The pump 2 supplies pressurized fluid, for example, to a fluid power operating brake circuit 36 diagrammatically depicted while the pump 3 supplies pressurized fluid to a fluid power steering circuit 38. Both pumps are operated by a common drive shaft 4 which carries an eccentric 5 engageable with a single radial piston plunger 6 of the pump 2 and the six radial piston plungers 7 of the pump 3. The drive shaft is mounted by axially spaced bearings in the housing for rotation about a rotational axis extending through a cylindrical chamber 8 that is disposed in eccentric relationship to the rotational axis. The eccentric chamber 8 is divided into separate compartments 11 and 12 by a steel disc 10. An arcuate groove 14 is formed in the external cylindrical surface of the eccentric 5 radially spaced a greater distance from the rotational axis of drive shaft 4 than the external surface portion 180° therefrom. The compartment separating disc 10 is seated in the groove 14 and is thereby held axially fixed to the eccentric. Bearing sleeves 15 and 15A are mounted on the eccentric 5 on opposite axial sides of the disc 10 to respectively support bearing races 16 and 16A thereon. The bearing races respectively engage the piston plungers associated with the pumps 2 and 3.

The piston plunger 6 of pump 2 is arranged to intake fluid under suction pressure at its radially outer end so as to operate in accordance with the so-called "top-filling" method. A chamber 17 to which the radially outer end of the plunger 6 is exposed is therefore in fluid communication with a fluid reservoir tank 40 during the suction intake phase of operation through a suction passage 18 and a suction port 20. A pressure outlet connection 21 establishes fluid communication between pump 2 and the fluid brake circuit through an outlet check valve 22 which is spring biased to a closed position during the suction intake phase and opened under pressure during a fluid delivery phase in a manner already well known in the art.

The pump 3 draws fluid through its six plungers 7 into the eccentric chamber 8 through bores 23 formed in the radially inner portions of the plungers. The pump 3 therefore operates in accordance with the so-called "bottom-filling method". The compartment 12 of the eccentric chamber 8 is in fluid communication with the suction port 20 through an axial bore 24, an inner annular channel 25 and an outer annular channel 26. A metal ring 27 formed with choke bores 28 is inserted between the two annular channels 25 and 26 arranged in radially aligned relationship to each other to form a flow restriction therebetween. The outer annular channel 26 is also in fluid communication with the compartment 11 of the eccentric chamber 8 through a choke bore 30 and equalizing passage 31 formed in the pump housing as shown by dotted line in FIG. 1.

The pressurized fluid delivered by pump 3 flows into a collecting chamber 34 through pressure passages 32 assigned to each of the plungers 7 and an outlet check valve 33 as shown in FIG. 1. A fluid outlet port 35 of the collecting chamber 34, supplies the pressurized fluid to the fluid steering circuit.

By dividing the eccentric chamber into compartments 11 and 12 by means of the disc 10 in accordance with the present invention, the fluid steering circuit is largely protected against pressure fluctuations caused by the plunger 6 of the pump 2 entering the eccentric chamber 8. The fluid displaced during the suction stroke of the plunger 6 from the compartment 11 of the eccentric chamber 8, flows through the equalizing passage 31. The choke bore 30 and the outer annular channel 26 into the suction intake port 20 and the inner annular channel 25. The choke bore 30 has a damping effect on the fluid return flow. Furthermore, increases in fluid flow rate into the compartment 12 induced by pump 3 through the inner annular channel 25, is isolated from the outer annular channel 26 by the choke bores 28. The metal ring 27 formed with the choke bores 28 additionally insures that the fluid return flow through the equalizing passage 31 from the compartment 11, does not interfere with the smooth filling of plungers 7. The foregoing arrangement also insures that the fluid steering circuit is virtually free of pressure gaps resulting from pressure fluctuations in the fluid brake circuit.

Instead of a single-piston pump supplying the fluid brake circuit, a multi-piston pump may be utilized. However, the pulsation dampening effect of a single-piston pump will then be only partially effective in the pump assembly because the pressure amplitude per revolution produced by such pump, reaches an extremely high value.

Figure 3:
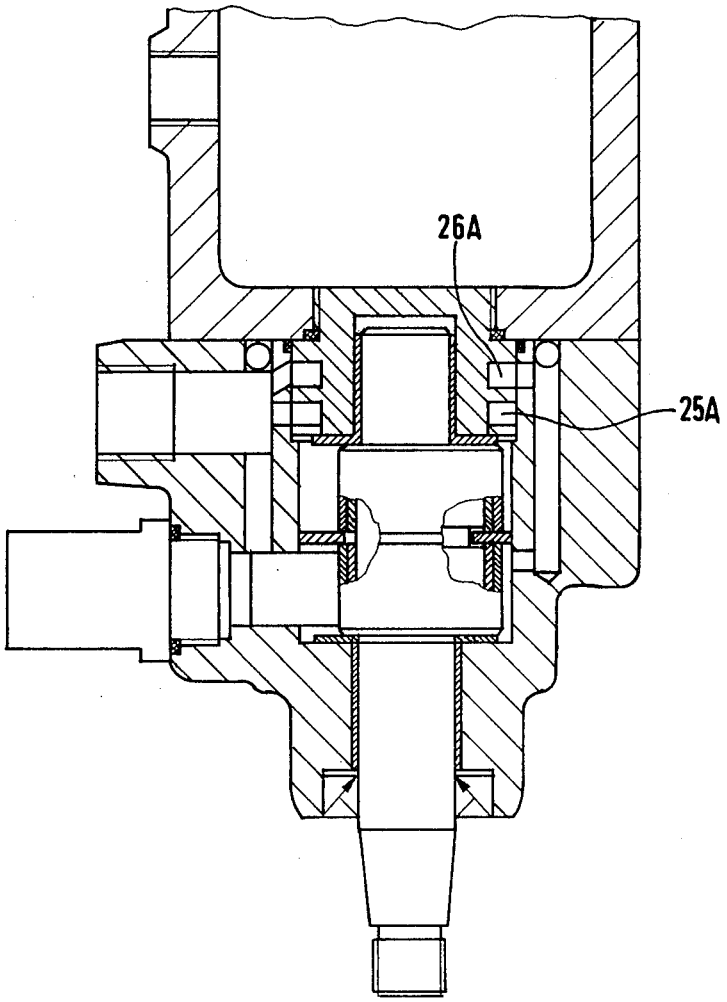
FIG. 3 is a simplified longitudinal section view through another embodiment of the invention.

FIG. 3 illustrates another embodiment of the invention which differs from that described in connection with FIGS. 1 and 2 in that annular channels 25A and 25B are provided in fluid communication with the common suction port 20, the channels 25A and 26A being spaced from each other axially and not arranged in radial alignment with each other. A further reduction in manufacturing costs is thereby achieved and yet provides for almost the equivalent pulsation dampening characteristics.

What is claimed is:

1. In a multiple pump assembly for supplying fluid from a common fluid reservoir to a plurality of fluid circuits, said pump assembly having a pump housing (1) and a drive shaft (4), the improvement residing in at least two radial piston pumps (2,3) having plungers (6,7) associated therewith, respectively, a common eccentric (5) mounted on the drive shaft having a common actuating surface in engagement with the plungers, said housing being formed with an eccentric chamber (8) enclosing the eccentric and a common suction port (20), and means mounted on the actuating surface of the common eccentric for dividing said eccentric chamber into separate compartments (11, 12) in fluid communication with said common suction port, said housing also being formed with annular channels (26/25, 26A/25A) through which fluid is conducted between the compartments and the common suction port.

2. In a multiple pump assembly for supplying fluid from a common fluid reservoir to a plurality of fluid circuits, said pump assembly having a pump housing (1) and a drive shaft (4), the improvement residing in at least two radial piston pumps (2, 3) having plungers (6, 7) associated therewith, respectively, a common eccentric (5) mounted on the drive shaft in engagement with the plungers, said housing being formed with an eccentric chamber (8) enclosing the eccentric and a common suction port (20), means mounted on the eccentric for dividing said eccentric chamber into separate compartments (11, 12) in fluid communication with said common suction port, annular channels (25, 26) radially arranged relative to each other in the housing conducting fluid between the compartments and the common suction port, and flow restricting means having choke bores (28) for establishing fluid communication between said annular channels.

3. In a multiple pump assembly for supplying fluid from a common fluid reservoir to a plurality of fluid circuits, said pump assembly having a pump housing (1) and a drive shaft (4), the improvement residing in at least two radial piston pumps (2, 3) having plungers (6, 7) associated therewith, respectively, a common eccentric (5) mounted on the drive shaft in engagement with the plungers, said housing being formed with an eccentric chamber (8) enclosing the eccentric and a common suction port (20), and means for dividing said eccentric chamber into separate compartments (11, 12) in fluid communication with said common suction port, said housing being formed with annular channels (26/25, 26A/25A) through which fluid is conducted between the compartments and the common suction port, said annular channels (25, 26) being radially arranged relative to each other and flow restricting means having choke bores (28) for establishing fluid communication between said annular channels, said flow restricting means further including a ring (27) within which the choke bores are formed.

4. In a multiple pump assembly for supplying fluid from a common fluid reservoir to a plurality of fluid circuits, said pump assembly having a pump housing (1) and a drive shaft (4), the improvement residing in at least two radial piston pumps (2,3) having plungers (6, 7) associated therewith, respectively, a common eccentric (5) mounted on the drive shaft in engagement with the plungers, said housing being formed with an eccentric chamber (8) enclosing the eccentric and a common suction port (2), and means mounted on the eccentric for dividing said eccentric chamber into separate compartments (11, 12) in fluid communication with said common suction port, said housing being formed with annular channels (26/25, 26A/25A) through which fluid is conducted between the compartments and the common suction port, the annular channels (25A, 26A) being in close axial spaced relationship to each other.

5. In a multiple pump assembly for supplying fluid from a common fluid reservoir to a plurality of fluid circuits, said pump assembly having a pump housing (1) and a drive shaft (4), the improvement residing in at least two radial piston pumps (2, 3) having plungers (6, 7) associated therewith, respectively, a common eccentric (5) mounted on the drive shaft in engagement with the plungers, said housing being formed with an eccentric chamber (8) enclosing the eccentric and a common suction port (20), and means for dividing said eccentric chamber into separate compartments (11, 12) in fluid communication with said common suction port, said housing being formed with annular channels (26/25, 26A/25A) through which fluid is conducted between the compartments and the common suction port, one of the compartments (11) being in fluid communication with the suction port through a radially outer one of the annular channels (26) and an equalizing passage (31) formed in the housing, a choke bore (30) being provided between the equalizing passage and the outer channel for restricting flow therebetween.

6. In combination with a plurality of fluid circuits to which fluid is supplied from a common reservoir by a multiple pump assembly, said pump assembly including a pump housing (1), a drive shaft (4), at least two axially spaced radial pistons (6, 7) mounted for reciprocation within the housing, a common eccentric fixed to the drive shaft in engagement with said pistons, said housing being formed with an eccentric chamber (8) enclosing the eccentric and a common suction port (20), means (10) for dividing said eccentric chamber into separate compartments (11, 12), within which the pistons are respectively engaged by the eccentric, and flow conducting means for establishing separate fluid communication between each of said compartments and the common suction port to minimize transfer of pressure fluctuations between the fluid circuits to which pressurized fluid is respectively supplied through the pistons, the flow conducting means including a first passage (25, 25A) conducting fluid between the suction port and one of the compartments (12), a second passage (26, 26A) conducting fluid from the suction port to another of the compartments (11), and means for dampening transfer of pressure fluctuations between said first and second passages, said dampening means comprising flow restricting means (27-28, 30-31) establishing restricted fluid communication between the passages and restricted fluid communication between said other of the compartments (11) and the second passage (26) which is in direct fluid communication with the suction port, said flow restricting means including a ring (27) having choke bores (28) formed therein, said first and second passages being channels radially separated by said ring.

7. In combination with a plurality of fluid circuits to which fluid is supplied from a common reservoir by a multiple pump assembly, said pump assembly including a pump housing (1), a drive shaft (4), at least two axially spaced radial pistons (6, 7) mounted for reciprocation within the housing, a common eccentric fixed to the drive shaft in engagement with said pistons, said housing being formed with an eccentric chamber (8) enclosing the eccentric and a common suction port (20), means (10) for dividing said eccentric chamber into separate compartments (11, 12), within which the pistons are respectively engaged by the eccentric, and flow conducting means for establishing separate fluid communication between each of said compartments and the common suction port to minimize transfer of pressure fluctuations between the fluid circuits to which pressurized fluid is respectively supplied through the pistons, the flow conducting means including a first passage (25, 25A) conducting fluid between the suction port and one of the compartments (12), a second passage (26, 26A) conducting fluid from the suction port to another of the compartments (11), and means for dampening transfer of pressure fluctuations between said first and second passages, said first and second passages being axially spaced annular channels (25A, 26A).

8. In combination with a plurality of fluid circuits to which fluid is supplied from a common reservoir by a multiple pump assembly, said pump assembly including a pump housing (1), a drive shaft (4), at least two axially spaced radial pistons (6, 7) mounted for reciprocation within the housing, a common eccentric fixed to the drive shaft in engagement with said pistons, said housing being formed with an eccentric chamber (8) enclosing the eccentric and a common suction port (20), means (10) mounted on the eccentric for dividing said eccentric chamber into separate compartments (11, 12), within which the pistons are respectively engaged by the eccentric, flow conducting means for establishing fluid flow paths from said compartments to the common suction port and means separating said flow paths from each other for minimizing transfer of pressure fluctuations between the fluid circuits to which pressurized fluid is respectively supplied through the pistons, the flow conducting means including a first passage (25, 25A) conducting fluid between the suction port and one of the compartments (12), a second passage (26, 26A) conducting fluid from the suction port to another of the compartments (11), and means for dampening transfer of pressure fluctuations between said first and second passages.

9. The combination as defined in claim 8 wherein said dampening means comprises flow restricting means (27–28, 30–31) establishing restricted fluid communication between the passages and restricted fluid communication between said other of the compartments (11) and the second passage (26) which is in direct fluid communication with the suction port.

* * * * *